US009549629B2

(12) United States Patent
Bourget et al.

(10) Patent No.: US 9,549,629 B2
(45) Date of Patent: Jan. 24, 2017

(54) SERVING TRAY SYSTEM

(71) Applicants: Brigitte Bourget, Boisbriand (CA); Robert Martel, Boisbriand (CA)

(72) Inventors: Brigitte Bourget, Boisbriand (CA); Robert Martel, Boisbriand (CA)

( * ) Notice: Subject to any disclaimer, the term of this patent is extended or adjusted under 35 U.S.C. 154(b) by 192 days.

(21) Appl. No.: 14/335,141

(22) Filed: Jul. 18, 2014

(65) Prior Publication Data

US 2015/0027919 A1 Jan. 29, 2015

(30) Foreign Application Priority Data

Jul. 23, 2013 (GB) ..... 1313099.2

(51) Int. Cl.
*A47G 23/06* (2006.01)

(52) U.S. Cl.
CPC ..... *A47G 23/0633* (2013.01); *A47G 23/0625* (2013.01)

(58) Field of Classification Search
CPC A47G 23/06; A47G 23/0608; A47G 23/0625; A47G 23/0633
USPC ..... 206/459.5, 557–565; 220/574, 575, 752; 224/255, 269, 270, 272
See application file for complete search history.

(56) References Cited

U.S. PATENT DOCUMENTS

| | | | | |
|---|---|---|---|---|
| 995,114 A | | 6/1911 | Chester et al. | |
| 1,953,933 A | | 4/1934 | Gundelach | |
| 2,295,860 A | | 9/1942 | Oliver | |
| 2,723,068 A | | 11/1955 | Ettwein | |
| 3,504,832 A | | 4/1970 | Corvetti | |
| D308,461 S | | 6/1990 | Hosea | |
| D314,693 S | | 2/1991 | Sata | |
| D317,389 S | | 6/1991 | Penaluna et al. | |
| 5,076,438 A | | 12/1991 | Aronson | |
| 5,209,370 A | * | 5/1993 | Pickett | A47G 23/0608 206/557 |
| 5,353,952 A | | 10/1994 | Donche | |
| D364,072 S | | 11/1995 | Keable | |
| D392,156 S | | 3/1998 | Michael | |
| D393,981 S | | 5/1998 | Lipkowitz | |
| 5,813,748 A | * | 9/1998 | Maxymych | A47G 23/00 206/564 |
| 5,960,982 A | | 10/1999 | Perlis et al. | |
| D612,689 S | | 3/2010 | White | |
| 7,717,483 B1 | | 5/2010 | Bombara | |

(Continued)

FOREIGN PATENT DOCUMENTS

| | | | | |
|---|---|---|---|---|
| HK | GB 2266447 A | * | 11/1993 | A47G 23/0625 |
| JP | 2006223776 A | | 8/2006 | |

*Primary Examiner* — Bryon Gehman

(57) ABSTRACT

A serving tray system usable by an intended user having a hand to carry objects, the hand having fingers and a thumb, the system comprising: a serving tray, the serving tray including a substantially rigid tray body defining a tray aperture extending therethrough; and a tray mounting element wearable by the intended user, the tray mounting element including a base and a tray mount extending from the base and insertable through the tray aperture to mount the serving tray to the tray mounting element. The serving tray is usable by the intended user to carry the objects thereon when the serving tray is separated from the tray mounting element and held by the hand. The serving tray is mountable to the tray mounting element by inserting the tray mount through the tray aperture to free the hand when the objects have been removed from the serving tray.

16 Claims, 4 Drawing Sheets

(56) References Cited

U.S. PATENT DOCUMENTS

| | | | | |
|---|---|---|---|---|
| D622,106 | S | 8/2010 | Bombara | |
| 7,975,623 | B1 | 7/2011 | Gassick et al. | |
| 8,113,380 | B2 | 2/2012 | Goren | |
| 8,746,456 | B1 * | 6/2014 | Bradley | A47G 19/065 206/562 |
| 2005/0056192 | A1 | 3/2005 | Marchand | |
| 2006/0032780 | A1 | 2/2006 | Heyn | |
| 2009/0167041 | A1 * | 7/2009 | James | A47G 23/0216 294/141 |

* cited by examiner

SERVING TRAY SYSTEM

FIELD OF THE INVENTION

The present invention relates generally to serving trays and, more particularly, to a serving tray system comprising a serving tray selectively mountable to a tray mounting element that can be worn by an intended user, and a method of using same.

BACKGROUND

Serving trays are well known in the art and are generally used by service personnel such as, for examples, waiters and waitresses in restaurants, bars and night clubs, for carrying a plurality of relatively light table items such as glasses, food plates, utensils and the likes.

A problem often arises when using these serving trays of the prior art which typically occurs, for example, in a crowded restaurant where a waiter handling an empty serving tray is called by a customer sitting at a dining table who is asking to pay the bill.

The waiter arrives at the table and, in order to handle the check pad, bill, money, and/or the remote credit card terminal, tries to find a proper place nearby to temporarily support the serving tray and, thus, free both hands for executing these manual operations.

In such crowded restaurants where free space anywhere nearby can be scarce, including on the table of the calling client, the service personnel more often than not has to settle for the only option available, which is temporarily holding the service tray clutched under an arm pit or between the legs, or lying on the corner of a step of a staircase, a stage floor, or the likes.

These various ways of temporarily holding or supporting a serving tray can raise serious safety and hygienic concerns. For example, laying the serving tray on a staircase step or stage floor may cause serious injuries to service personnel, clients and artists alike. Hygienic concerns are particularly raised during hot and humid summer days on exterior terraces and in not so well ventilated restaurants and bars, where the service personnel often wears short sleeve shirts and short pants such that surface portions of the serving trays are in direct contact with sweaty skin.

There is a multitude of prior art serving trays that can generally fulfill the main objective of allowing a single person to conveniently carry a plurality of relatively light items. However, these serving trays are also inefficient in solving the safety and hygienic concerns mentioned hereinabove since they generally do not offer a means for temporarily holding the serving tray when empty.

Against this background, there exists a need for an improved serving tray. An object of the present invention is to provide such a serving tray.

SUMMARY OF THE INVENTION

In a broad aspect the invention provides a serving tray system usable by an intended user having a hand to carry objects, the hand having fingers and a thumb, the system comprising: a serving tray, the serving tray including a substantially rigid tray body defining a tray aperture extending therethrough; and a tray mounting element wearable by the intended user, the tray mounting element including a base and a tray mount extending from the base and insertable through the tray aperture to mount the serving tray to the tray mounting element. The serving tray is usable by the intended user to carry the objects thereon when the serving tray is separated from the tray mounting element and held by the hand. The serving tray is mountable to the tray mounting element by inserting the tray mount through the tray aperture to free the hand when the objects have been removed from the serving tray.

In some embodiments, the tray body defines a bottom wall, the bottom wall defining a bottom wall peripheral edge, the tray aperture extending through the bottom wall, for example in a spaced apart relationship relative to the bottom wall peripheral edge.

In some embodiments, the serving tray defines a center of mass, the tray aperture being offset relative to the center of mass.

In some embodiments, the tray aperture is configured and sized for preventing insertion therethrough of any one of the fingers.

In some embodiments, the tray bottom wall is substantially disc-shaped.

In some embodiments, the tray aperture includes a wider portion and a narrower portion extending therefrom, the narrower portion being closer to the bottom wall peripheral edge than the wider portion, the narrower portion extending circumferentially over a smaller distance than the wider portion.

In some embodiments, the tray mount includes a shaft extending from the base and an enlarged portion extending from the shaft spaced apart from the base, the shaft being configured and sized so as to be receivable in the narrower portion, the enlarged portion being configured and sized so as to be insertable through the wider portion while being prevented from being inserted through the narrower portion, the shaft having a length that is at least as large as a thickness of the serving tray substantially adjacent the tray aperture.

In some embodiments, at least part of the tray aperture is between 1 and 5 inches away from the bottom wall peripheral edge.

In some embodiments, the serving tray also defines a ledge extending from the bottom wall substantially adjacent the bottom wall peripheral edge.

In some embodiments, the tray aperture is substantially key-hole shaped.

In some embodiments, the tray mounting element includes a clip extending from the base for clipping the tray mounting element to a piece of clothing or a belt worn by the intended user.

In some embodiments, the tray mounting element includes a belt wearable by the intended user, the base being part of the belt.

In some embodiments, the tray aperture is configured and sized to allow the intended user to position at least one of the fingers in register with at least part of the tray aperture when holding the serving tray exclusively with the hand.

In some embodiments, the tray is provided with indicia substantially adjacent the tray aperture.

In some embodiments, the indicia surround the tray aperture. In some embodiments, the indicia are luminescent.

In a variant, the tray aperture extends through the serving tray. In another variant, the tray body defines an aperture peripheral region surrounding the tray aperture, the serving tray further comprising a deformable patch covering the tray aperture and the aperture peripheral region, the deformable patch defining a patch peripheral region, the deformable patch being secured to the aperture peripheral region in the patch peripheral region. In some embodiments, the patch is luminescent.

In another broad aspect, the invention provides a method of using a serving tray system as defined above, the method comprising: (a) wearing the tray mounting element so that the tray mount is accessible; (b) holding the serving tray between the thumb and at least one of the fingers, the at least one of the fingers being positioned so that at least part thereof is substantially in register with the tray aperture; (c) while holding the serving tray as defined in step (b), moving the serving tray so that the tray aperture is substantially adjacent to the tray mounting element and then moving the serving tray until the tray mount is felt by the at least one finger though the tray aperture; and (d) after step (c), inserting the tray mount through the tray aperture and suspending the serving tray to the tray mount.

The proposed serving tray system may be manufactured cost effectively using known materials and method. In some embodiments, the actual operation of grabbing and engaging the serving tray on the tray mounting element may eventually be done almost instinctively while the intended user visually keeps his or her attention on the surroundings to avoid work colleagues, clients or objects passing nearby in a crowded and/or active environment. Also, mounting the serving tray to the tray mounting element provides a relatively secure attachment of the tray thereto. Furthermore, detachment of the serving tray from the tray mounting element may be performed fluidly, without sudden movements, as would be the case with a serving tray secured using miniature hook and loop materials, magnets or push buttons. Therefore, the proposed serving tray system can significantly improve the safety levels of serving personnel and clients alike since the serving personnel may spend less time bothering with the handling of an empty serving tray, and more time paying attention to the sometimes highly active environment in which they work.

Furthermore, the proposed serving tray system can significantly improve the general salubrity and hygiene levels of environments in which there are serving personnel and clients since the serving personnel now has a convenient way of temporarily holding an empty serving tray.

Still furthermore, the proposed serving tray system that is not significantly more complex to operate and use compared to conventional serving tray of the prior art.

Other objects, advantages and features of the present invention will become more apparent upon reading of the following non-restrictive description of some embodiments thereof, given by way of example only with reference to the accompanying drawings.

DETAILED DESCRIPTION

Figure 1:
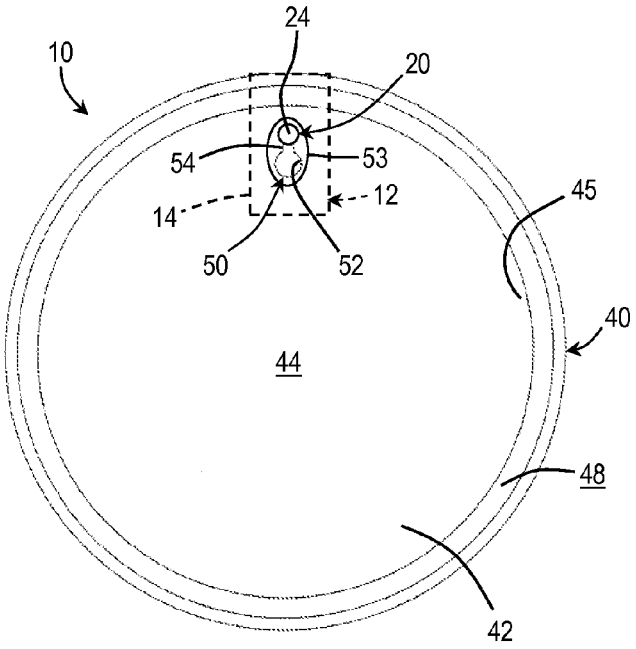
FIG. 1, in a top plan view, illustrates a serving tray system including a serving tray and a tray mounting element according to an embodiment of the present invention, the serving tray system being here shown with the serving tray having a tray aperture thereof engaged on the tray mounting element.
Figure 2:
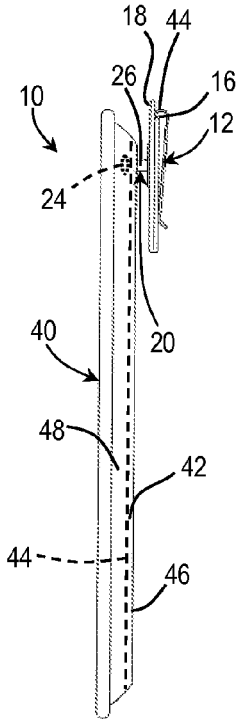
FIG. 2, in a side plan view, illustrates the serving tray system of FIG. 1.
Figure 3:
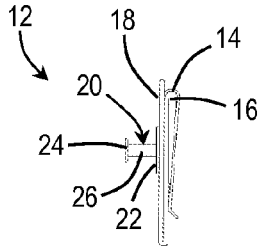
FIG. 3, in a side plan view, illustrates the tray mounting element shown in FIGS. 1 and 2.
Figure 4:
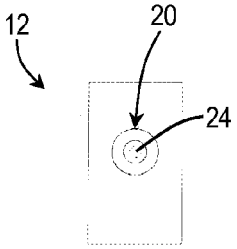
FIG. 4, in a front plan view, illustrates the tray mounting element shown in FIGS. 1 to 3.
Figure 5:
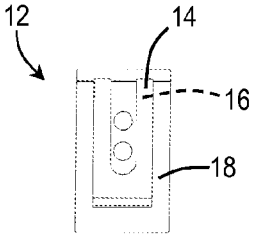
FIG. 5, in a rear plan view, illustrates the tray mounting element shown in FIGS. 1 to 4.
Figure 6:
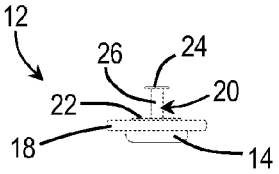
FIG. 6, in a top plan view, illustrates the tray mounting element shown in FIGS. 1 to 5.
Figure 7:
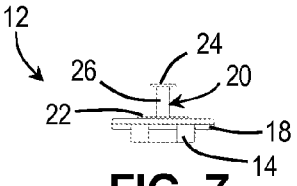
FIG. 7, in a bottom plan view, illustrates the tray mounting element shown in FIGS. 1 to 6.

FIGS. 1 and 2 show various aspects of a serving tray system 10 according to an embodiment of the present invention. The serving tray system 10 is usable by an intended user (not shown in the drawings) having a hand 152 (shown in FIG. 13 for example) to carry objects (not shown in the drawings). The hand 152 has fingers 154 and a thumb 156, the term "fingers" excluding the thumb 156 for the purpose of the present document. Returning to FIGS. 1 and 2, the serving tray system 10 includes a tray mounting element 12 and a serving tray 40.

The term "substantially" is used throughout this document to indicate variations in the thus qualified terms. These variations are variations that do not materially affect the manner in which the invention works and can be due, for example, to uncertainty in manufacturing processes or to small deviations from a nominal value that do not cause significant changes to the invention. These variations are to be interpreted from the point of view of the person skilled in the art. Also, directional terminology such as top and bottom, among others, is used in this document and refer to the serving tray system 10 in a typical operational configuration wherein the serving tray 40 is used to support objects thereon. This terminology is used for clarity reasons and should not be used to restrict the scope of the appended claims unless explicitly mentioned in the claims.

The tray mounting element 12 is wearable by the intended user. For the purpose of the present document, "wearable" is defined as the ability of being directly worn by the intended user, such as a belt would be, or securable to a piece of clothing or to a clothing accessory that is worn by the intended user. FIGS. 1 and 2 illustrate an example of a tray mounting element 12 that meets the second definition of "wearable" as the tray mounting element 12 is selectively attachable to a user's waist belt such as, for example, a custom leather, canvas or nylon waist belt commonly used by waiters and waitresses for carrying a check pad holder, a money purse and the likes. The tray mounting element 12 may also be attached in some embodiments directly to the waist portion of pants, a skirt or any other type of clothes worn by the intended user. The tray mounting element 12 is typically worn substantially proximal the hip region of the intended user. However, other positions for the tray mounting element 12 are also possible.

As best illustrated in FIGS. 3 to 7 inclusively, the tray mounting element 12 includes a base 18 from which a clip 14 and a tray mount 20 extend. The clip 14 is provided for clipping the tray mounting element 12 to a piece of clothing or a belt worn by the intended user. The clip 14 is a conventional clip 14 of the type defining a substantially U-shaped recess 16 extending inwardly upwardly relative thereto, for selectively resiliently engaging at least a top portion of the intended user's waist belt, pants, skirt or other piece of clothing.

The tray mount 20 defines for example a shaft 26 extending from the base 18 and an enlarged portion 24 extending from the shaft 26 spaced apart from the base 18. In some embodiments, the shaft 26 defines a shaft base 22 fixedly secured to the base 18. For example, the tray mount 20 may be typically represented by a conventional leather strap engaging button commonly found on musical instruments, such as a guitar or the like.

The serving tray 40 includes a substantially rigid tray body, which in the embodiment shown in FIGS. 1 and 2 constitutes the entire serving tray 40. "Substantially rigid" as used to describe the tray body means that the tray body is rigid enough to allow carrying objects commonly carried using serving trays, such as plates of food and glasses containing beverages, without the serving tray 40 experiencing deformations that would be large enough to cause these objects to fall easily from the serving tray 40. As seen for example in FIG. 1, the tray body defines a tray aperture 50 extending therethrough. The tray mount 20 is insertable through the tray aperture 50 to mount the serving tray 40 to the tray mounting element 12.

Figure 13:
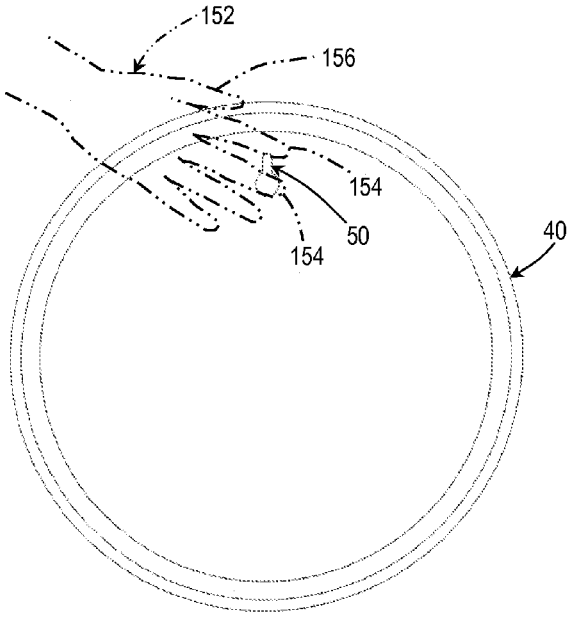
FIG. 13, in a top plan view, illustrates a method of handling the serving tray of FIGS. 1 and 2.

The serving tray 40 is usable by the intended user to carry objects thereon when the serving tray 40 is separated from the tray mounting element 12 and held by the hand 152, as seen for example in FIG. 13. The serving tray is 40 mountable to the tray mounting element 12 to free the hand 152 when the objects have been removed from the serving tray 40, as seen for example in FIGS. 1 and 2.

More specifically, referring to FIGS. 1 and 2, in a typical embodiment, the serving tray 40 has a substantially circular configuration. Thus, typically, the tray body defines a substantially disc-shaped bottom wall 42. The bottom wall 42 defines a bottom wall peripheral edge 45 (better shown in FIG. 1), a top surface 44, a bottom surface 46 (not shown in FIG. 1) opposed to the top surface 44, and a ledge 48 extending from the bottom wall 42 substantially adjacent the bottom wall peripheral edge 45. The tray aperture 50 extends through the bottom wall 42, typically in a space apart relationship relative to the bottom wall peripheral edge 45 so that the tray aperture 50 is surrounded by material constituting the bottom wall 42. Typically, the serving tray 40 defines a center of mass and the tray aperture 50 is offset relative to the center of mass.

Also, in some embodiments of the invention, the tray aperture 50 is configured and sized for preventing insertion therethrough of any one of the fingers 154. In some embodiments, the tray aperture 50 is configured and sized to allow the intended user to position at least one of the fingers 154 in register with at least part of the tray aperture 50 when holding the serving tray 40 exclusively with the hand 152. For example, this is achieved when at least part of the tray aperture 50 is between 1 and 5 inches, for example 2 inches, away from the bottom wall peripheral edge 45. However, in alternative embodiments of the invention, the serving tray 40 has any other suitable shape, such as any shape known in the art of serving trays.

The tray aperture 50 extends from the top surface 44 to the bottom surface 46. The tray aperture 50 typically has a substantially key-hole shaped configuration defining a wider portion 52 and a narrower portion 54 extending therefrom. The narrower portion 54 is closer to the bottom wall peripheral edge 45 than the wider portion 52. The narrower portion 54 extends circumferentially over a smaller distance than the wider portion 52. For example, the wider portion 52 is substantially circular while the narrower portion 54 is substantially rectilinear and oriented substantially radially so as to extend from the wider portion 52 substantially towards the ledge 48 of the serving tray 40. The shaft 26 is configured and sized so as to be receivable in the narrower portion 54 and the enlarged portion 24 is configured and sized so as to be insertable through the wider portion 52 while being prevented from being inserted through the narrower portion 54. The distance between the base 18 and the enlarged portion 24 is at least as large as the distance between the top and bottom surfaces 44 and 46 adjacent the tray aperture 50. In other words, the shaft 26 has a length that is at least as large as a thickness of the serving tray 40 substantially adjacent the tray aperture 50.

Other equivalent shape configurations of a tray aperture 50 are also possible. For example, the tray aperture 50 may have a substantially water drop shaped configuration where the smaller end thereof is oriented towards the ledge 48 of the serving tray 40.

A method of using the serving tray system 10 will now be described. Beforehand, the intended user wears the tray mounting element 12 so that the tray mount 20 is accessible, typically at the waist region, and the serving tray is resting, for example, on an adjacent table top or service bar with the tray aperture 50 positioned adjacent to the intended user.

In a first step, the intended user contact a fingertip of at least one finger 154, such as, for example, the index, on the top surface 44 so that the at least one of the fingers 154 is being positioned so that at least part thereof is substantially in register with the tray aperture 50. Then, the intended user grasps an edge portion of the serving tray 40 between the fingertip pressing thereon and the thumb 156 pressing on an underside portion of the ledge 48 or the bottom surface 46. Thus, the serving tray is held between the thumb 156 and at least one of the fingers 154.

In a second step, with the fingertip of the at least one finger 154 thus covering at least part of the tray aperture 50 along the top surface 44, the serving tray 40 may be handled such that the portion of the bottom surface 46 that is opposite the position of the fingertip pressing on the tray aperture 50, is abutting substantially in register on the outer distal end of the tray mount 20 of the tray mounting element 12. This action thus moves the serving tray 40 so that the tray aperture 50 is substantially adjacent to the tray mount 20, and the serving tray 40 can then be moved until the tray mount 20 is felt by the at least one finger 154 though the tray aperture 50.

More specifically, as it will be apparent to someone skilled in the art, with only a typically relatively small repositioning of the serving tray 40 relative to the tray mount 20, the enlarged portion 24 thereof may relatively quickly enter and be felt with the fingertip when protruding through the wider portion 52 of the key-hole shaped tray aperture 50, followed with the shaft 26 being engaged along the narrower portion 54 thereof.

In a fourth step, with the tray mount 20 thus inserted and firmly engaged in the tray aperture 50, the serving tray may be left solely suspended on the tray mount 20, freeing both hands of the intended user for other, more productive tasks than having to handle an empty service tray.

As can be obvious to someone versed in the art, in a relatively short time the intended user may reach a familiarity with the day-to-day usage of the serving tray system 10 of the present invention such that, just after visually locating the position of the tray aperture 50, he or she only needs to initiate the movement of the hand 152 towards the serving tray 40 in order to complete the operations described in the first three steps of the method above, without having to actually laying his or her eyes on the operation occurring.

In other words the actual operation of grabbing and engaging the serving tray 40 on the tray mounting element 12 may eventually be done almost instinctively while the intended user visually keeps his or her attention on the surroundings to avoid work colleagues, clients or objects passing nearby in a crowded and/or active environment.

Thus, the particular combination represented by the tray aperture 50 and tray mount 20 provides an advantage that could not be readily achieved with other combinations of removable attachment means such as paired snap button elements, paired miniature hook and loop material (Velcro (™)) elements, paired magnet elements, or the likes, since these require a closer visual attention from the intended user to align and attach the paired elements together.

Also, another advantage of the tray aperture 50 and tray mount 20 combination resides in that these paired elements provide a relatively more secure attachment means than the other paired elements mentioned above, since a relatively greater force is required to separate both.

Yet another advantage of the tray aperture 50 and tray mount 20 combination over the other paired elements mentioned above resides in that a relatively smaller force is required to disengage these paired elements, as exemplified in the next step of the method. In contrast, the other paired elements such as paired snap button elements, paired miniature hook and loop material (Velcro(™)) elements, paired magnet elements, or the likes, typically require a significantly greater amount of manual force to separate. And when they do separate, they do so substantially suddenly which, in turn, may cause incidents such as the serving tray 40 bumping on and knocking over glasses, food plates and the likes lying, for example, on an adjacent table top.

In a fifth step, in order to use the serving tray 40 thus engaged on the tray mounting element 12, the intended user may simply slightly lift, then disengage the serving tray 40 from the tray mount 20 in order to carry items therewith in a conventional manner.

The above described serving tray system 10 may be modified n many ways while still achieving the above-mentioned advantages.

Figure 8:
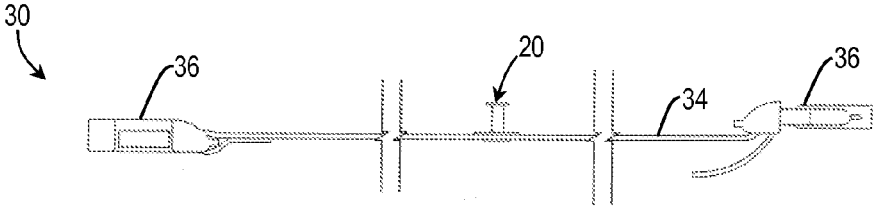
FIG. 8: in a side plan view, illustrates an alternative tray mounting element usable with the serving tray shown in FIGS. 1 and 2.
Figure 9:
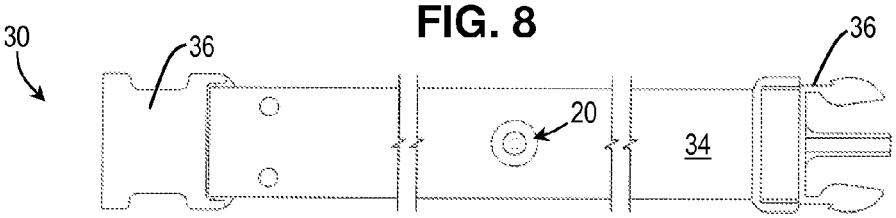
FIG. 9, in a front plan view, illustrates the tray mounting element of FIG. 8.
Figure 10:
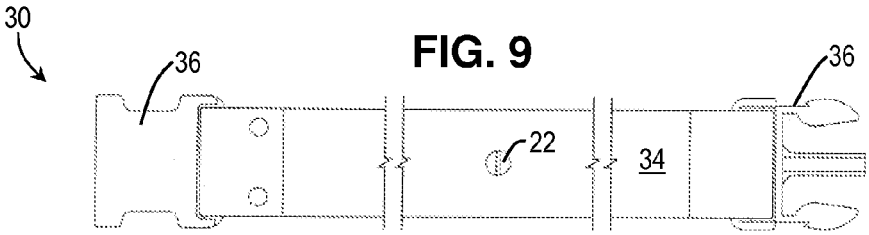
FIG. 10, in a rear plan view, illustrates the tray mounting element of FIGS. 8 and 9.

For example, FIGS. 8, 9 and 10 illustrate an alternative embodiment of a tray mounting element 30. In this embodiment, the base 18 and the clip 14 are replaced by a conventional waist belt element 32 worn about the waist of the intended user in a conventional manner. In this particular tray mounting element 30, the waist belt element 32 typically includes a substantially elongated band 34 provided with belt buckle elements 36 at the opposite distal ends thereof, and defines a waist belt outer surface to which is fixedly attached the tray mount 20 described further above. Thus part of the elongated band 34 acts like the base 18 so that the tray mount 20 can be secured thereto.

In some embodiments of the serving tray 40, a bright color or luminescent indicia 53 is applied substantially adjacent the tray aperture 50, for allowing the intended user to more easily visually locate the position of the tray aperture 50 in order to initiate the movement of the hand 152 towards the latter, as described above, in poorly lit environments such as night clubs and the like. For example, a contour line of bright or luminescent color may surround the tray aperture 50. Other indicia 53 configurations are also possible.

Figure 11:
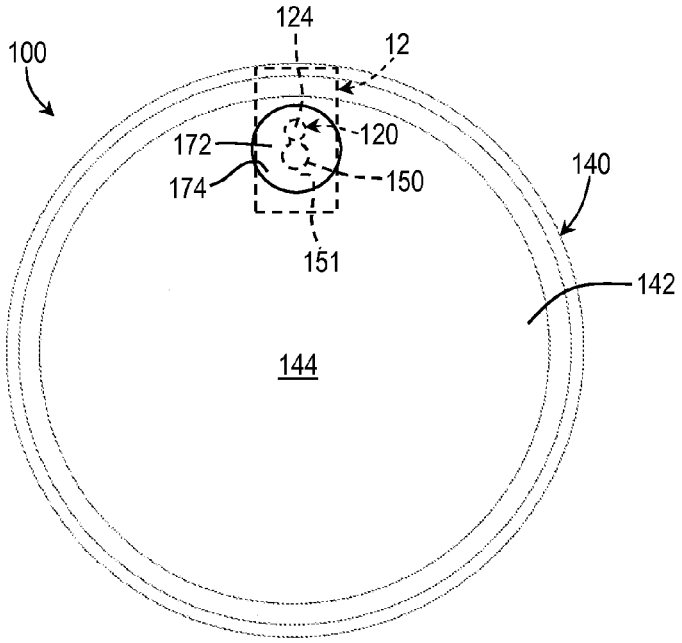
FIG. 11, in a top plan view, illustrates a serving tray system including a serving tray and a tray mounting element according to an alternative embodiment of the present invention, the serving tray system being here shown with the serving tray having a tray aperture thereof engaged on the tray mounting element.
Figure 12:
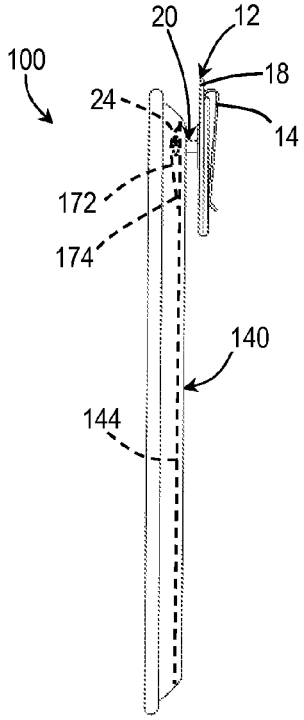
FIG. 12, in a side plan view, illustrates the serving tray system of FIG. 11.
Figure 14:
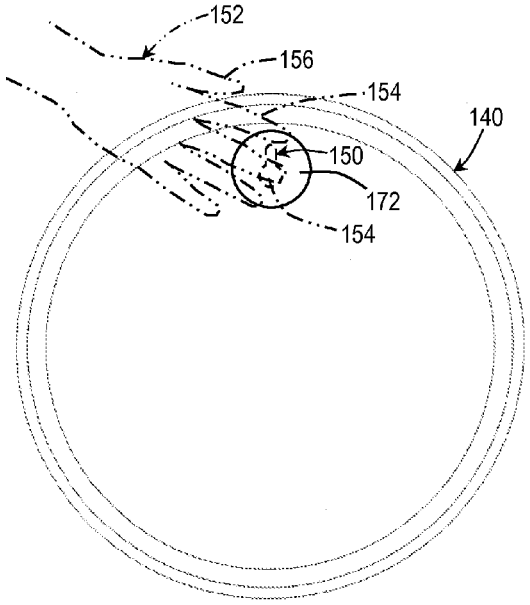
FIG. 14, in a top plan view, illustrates a method of handling the serving tray of FIGS. 11 and 12.

In the embodiment of the invention seen in FIGS. 1 and 2, the tray aperture 50 extends through the serving tray 40. However, in alternative embodiments, as seen in FIGS. 11, 12 and 14, an alternative serving tray system 100 is substantially similar to the serving tray system 10 described hereinabove. The difference resides in that the serving tray 140 of the serving tray system 100 defines an aperture peripheral region 151 surrounding the tray aperture 150. The serving tray further comprises a deformable patch 172 covering the tray aperture 150 and the aperture peripheral region 151. The deformable patch 172 defines a patch peripheral region 174, the deformable patch 172 being secured to the aperture peripheral region 151 in the patch peripheral region 174. Typically, the patch 172 is made of a substantially deformable material, such as an elastomeric and fluid impermeable material, for example rubber, and may have its whole patch peripheral region 174 sealably attached to the top surface 144 in order to hermetically cover the tray aperture 150.

Typically, the patch 172 is suitably sized and shaped to cover at least a slightly greater surface portion than the tray aperture 150, for allowing the enlarged portion 24 of the tray mount 20 to be freely movable within the tray aperture 150 once it has been inserted therethrough and is at least slightly protruding from the top surface 144, as best illustrated in FIG. 12. The patch peripheral region 174 of the patch 172 may be sealably attached thereto using any suitable means or process such as glue, double adhesive tape, a thermal bonding process, or the likes.

Thus, the sealed patch 172 covering the tray aperture 150 prevents any fluid present on the top surface 144 to flow or otherwise drip through the tray aperture 150, while at the same time allowing the handling of the serving tray 140 and its selective attachment operation to the tray mounting element 12 in a manner that is substantially identical to the method described further above since the insertion of the enlarged portion 24 may still be felt entering and protruding through the tray aperture 150, as illustrated in FIG. 14.

Furthermore, the top surface 144 may be provided with a relatively shallow planar recess (no shown in the drawings) having a shape and size configuration that is in register with the the patch 172 such that the latter forms a substantially homogenous surface with the surrounding top surface 144. The patch 172 thus uniformly embedded in the top surface 144 allows for a substantially efficient cleaning and disinfection of the top surface 144.

Yet furthermore, the patch 172 may be of a bright or luminescent color for easily locating its position when the intended user is serving in poorly lit environments such as night clubs or the like.

Although the present invention has been described hereinabove by way of exemplary embodiments thereof, it will be readily appreciated that many modifications are possible in the exemplary embodiments without materially departing from the novel teachings and advantages of this invention. Accordingly, the scope of the claims should not be limited by the exemplary embodiments, but should be given the broadest interpretation consistent with the description as a whole. The present invention can thus be modified without departing from the spirit and nature of the subject invention as defined in the appended claims.

What is claimed is:

1. A serving tray system usable by an intended user having a hand to carry objects, the hand having fingers and a thumb, said system comprising:

a serving tray, said serving tray including a substantially rigid tray body defining a tray aperture extending therethrough, said tray body defining a bottom wall, said bottom wall defining a bottom wall peripheral edge, said tray aperture extending through said bottom wall, said aperture including a wider portion and a narrower portion extending therefrom, said narrower portion being closer to said bottom wall peripheral edge than said wider portion, said narrower portion extending circumferentially over a smaller distance than said wider portion; and a tray mounting element wearable by the intended user, said tray mounting element including a base and a tray mount extending from said base and insertable through said tray aperture to mount said serving tray to said tray mounting element, said tray mount including a shaft extending from said base and an enlarged portion extending from said shaft spaced apart from said base, said shaft being configured and sized so as to be received in said narrower portion, said enlarged portion being configured and sized so as to be inserted through said wider portion while being prevented from being inserted through said narrower portion, said shaft having a length that is at least as large as a thickness of said serving tray substantially adjacent said tray aperture;

wherein said serving tray is usable by the intended user to carry the objects thereon when said serving tray is separated from said tray mounting element and held by the hand; and said serving tray is mountable to said tray mounting element by inserting said tray mount through said tray aperture to free the hand when the objects have been removed from said serving tray.

2. A system as defined in claim 1, wherein said serving tray defines a center of mass, said tray aperture being offset relative to said center of mass.

3. A system as defined in claim 1, wherein said tray aperture is configured and sized for preventing insertion therethrough of any one of the fingers.

4. A system as defined in claim 1, wherein said tray bottom wall is substantially disc-shaped.

5. A system as defined in claim 1, wherein at least part of said tray aperture is between 1 and 5 inches away from said bottom wall peripheral edge.

6. A system as defined in claim 1, wherein said tray aperture extends through said bottom wall in a spaced apart relationship relative to said bottom wall peripheral edge.

7. A system as defined in claim 1, wherein said tray aperture is substantially key-hole shaped.

8. A system as defined in claim 1, wherein said tray mounting element includes a clip extending from said base for clipping said tray mounting element to a piece of clothing or a belt worn by the intended user.

9. A system as defined in claim 1, wherein said tray mounting element includes a belt wearable by the intended user, said base being part of said belt.

10. A system as defined in claim 1, wherein said tray aperture is configured and sized to allow the intended user to position at least one of the fingers in register with at least part of said tray aperture when holding said serving tray exclusively with the hand.

11. A system as defined in claim 1, wherein said tray is provided with indicia substantially adjacent said tray aperture.

12. A system as defined in claim 11, wherein said indicia surround said tray aperture.

13. A system as defined in claim 11, wherein said indicia are luminescent.

14. A system as defined in claim 1, wherein said tray aperture extends through said serving tray.

15. A system as defined in claim 1, wherein said tray body defines an aperture peripheral region surrounding said tray aperture, said serving tray further comprising a deformable patch covering said tray aperture and said aperture peripheral region, said deformable patch defining a patch peripheral region, said deformable patch being secured to said aperture peripheral region in said patch peripheral region.

16. A system as defined in claim 15, wherein said patch is luminescent.

* * * * *